US010629401B2

(12) United States Patent
Rangi et al.

(10) Patent No.: US 10,629,401 B2
(45) Date of Patent: Apr. 21, 2020

(54) FUSE ADAPTER

(71) Applicant: Lear Corporation, Southfield, MI (US)

(72) Inventors: Bhupinder Rangi, Novi, MI (US); David Menzies, Linden, MI (US); Michael Glick, Farmington Hills, MI (US); Lewis Galligan, Novi, MI (US); Imad Beydoun, Dearborn, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/678,960

(22) Filed: Aug. 16, 2017

(65) Prior Publication Data

US 2018/0130627 A1 May 10, 2018

Related U.S. Application Data

(60) Provisional application No. 62/377,916, filed on Aug. 22, 2016.

(51) Int. Cl.

| | |
|---|---|
| ***H01H 85/54*** | (2006.01) |
| ***H01H 85/20*** | (2006.01) |
| ***H01H 85/165*** | (2006.01) |
| ***H01R 33/95*** | (2006.01) |

(52) U.S. Cl.

CPC ..... *H01H 85/54* (2013.01); *H01H 85/165* (2013.01); *H01H 85/20* (2013.01); *H01R 33/95* (2013.01)

(58) Field of Classification Search

CPC ..... H01H 85/165; H01H 85/20; H01H 85/22; H01H 85/48; H01H 85/50; H01H 85/54; H01H 85/547; H01H 85/56; H01H 85/58; H01H 85/60; H01H 2085/206

USPC ..... 337/205

See application file for complete search history.

(56) References Cited

U.S. PATENT DOCUMENTS

| | | | | |
|---|---|---|---|---|
| 3,513,425 | A | 5/1970 | Arndt | |
| 5,816,858 | A * | 10/1998 | Kazarian | H01H 85/2045 439/620.26 |
| 7,268,300 | B2 | 9/2007 | Miyazaki | |
| 7,568,921 | B2 | 8/2009 | Pavlovic et al. | |
| 7,967,622 | B2 | 6/2011 | Brütsch et al. | |
| 2008/0242150 | A1* | 10/2008 | Chikamatsu | H01H 85/0208 439/620.3 |
| 2009/0001812 | A1* | 1/2009 | Brooks | H01H 85/0417 307/10.1 |
| 2010/0102920 | A1* | 4/2010 | Stanek | H01H 85/0013 337/186 |
| 2010/0124834 | A1* | 5/2010 | De Chazal | H01H 9/104 439/271 |
| 2010/0259355 | A1* | 10/2010 | Buettner | H01H 85/25 337/187 |

(Continued)

*Primary Examiner* — Jacob R Crum

(74) *Attorney, Agent, or Firm* — MacMillan, Sobanski & Todd, LLC

(57) ABSTRACT

A fuse adapter assembly includes a fuse adapter having an adapter base. A fuse shroud extends from the adapter base and defines a fuse cavity. An adapter shroud also extends from the adapter base and defines an adapter terminal space. A fuse terminal opening passes through the adapter base between the fuse cavity and the adapter terminal space. A fuse enclosure is located within the fuse cavity and is configured to retain a fuse. The fuse cavity is configured to engage a header and the adapter shroud is configured to engage an electrical connector.

17 Claims, 13 Drawing Sheets

(56) References Cited

U.S. PATENT DOCUMENTS

2010/0328018 A1* 12/2010 Matsumoto ..... H01H 85/0417
337/187
2011/0306243 A1* 12/2011 Shiraki ..... H01R 11/287
439/620.29

* cited by examiner

FUSE ADAPTER

CROSS-REFERENCE TO RELATED APPLICATIONS

This application claims the benefit of U.S. Provisional Application No. 62/377916, filed Aug. 22, 2016, the disclosure of which is incorporated herein by reference.

BACKGROUND OF THE INVENTION

In electrical systems, a bus bar is adapted to act as a conductive connector between a power or signal source and various relays, circuit breakers, and other electronic connections. In conventional systems, the bus bar is often pre-formed with a variety of exposed contacts at predetermined locations. For example, U.S. Pat. No. 7,268,300 shows a bus bar assembly that includes multiple bus bars with a plurality of terminals extending therefrom. A housing, shown in FIG. 1, surrounds the bus bar assembly and provides protection and electrical insulation for the bus bars while also allowing the terminals to be connected to terminals on an apparatus. U.S. Pat. No. 7,967,622 shows bus bars that have terminals extending therefrom. The bus bars are retained in an insulating bottom part and cover pieces which clip onto the bottom part. The cover includes partition walls that partially surround the terminals but allow access to the terminals. It would be advantageous to have an improved system to access the terminals on a bus bar.

Electrical systems often include fuses to protect against over current conditions. Circuits are commonly routed through a fuse box, where multiple fuses are located. The fuse box protects the fuses, and provides access to the fuses so that damaged fuses may be replaced. It would be advantageous to have an improved system to protect and provide access to fuses.

SUMMARY OF THE INVENTION

This invention relates to a fuse adapter having an adapter base. A fuse shroud extends from the header base and defines a fuse cavity. An adapter shroud also extends from the adapter base and defines an adapter terminal space. A fuse terminal opening passes through the adapter base between the fuse cavity and the adapter terminal space. A fuse enclosure is located within the fuse cavity and is configured to retain a fuse. The fuse cavity is configured to engage a header and the adapter shroud is configured to engage an electrical connector.

In another embodiment, the invention relates to a fuse adapter a having an adapter base. A fuse shroud extends from the adapter base and defines a fuse cavity. The fuse adapter further includes a fuse enclosure located within the fuse cavity. The fuse enclosure includes an open end that is configured for the insertion of a fuse into the fuse enclosure. The fuse includes a first fuse terminal and a second fuse terminal. The first fuse terminal is located within the fuse enclosure and is aligned with a terminal opening defined in the fuse enclosure. The second fuse terminal extends out of the fuse enclosure through the open end and into the adapter terminal space. The fuse adapter may also include a fuse lock that retains the fuse in the fuse adapter. The fuse shroud may also include a lock window that allows an operator to release the fuse lock. The fuse adapter can be mated with a header assembly so that a terminal moves through the terminal opening and engages the first fuse terminal inside the fuse enclosure. An adapter shroud also extends from the adapter base and defines an adapter terminal space. The adapter shroud is configured to engage an electrical connector having a connector terminal. The connector terminal engages the second fuse terminal when the connector is mated with the fuse adapter.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
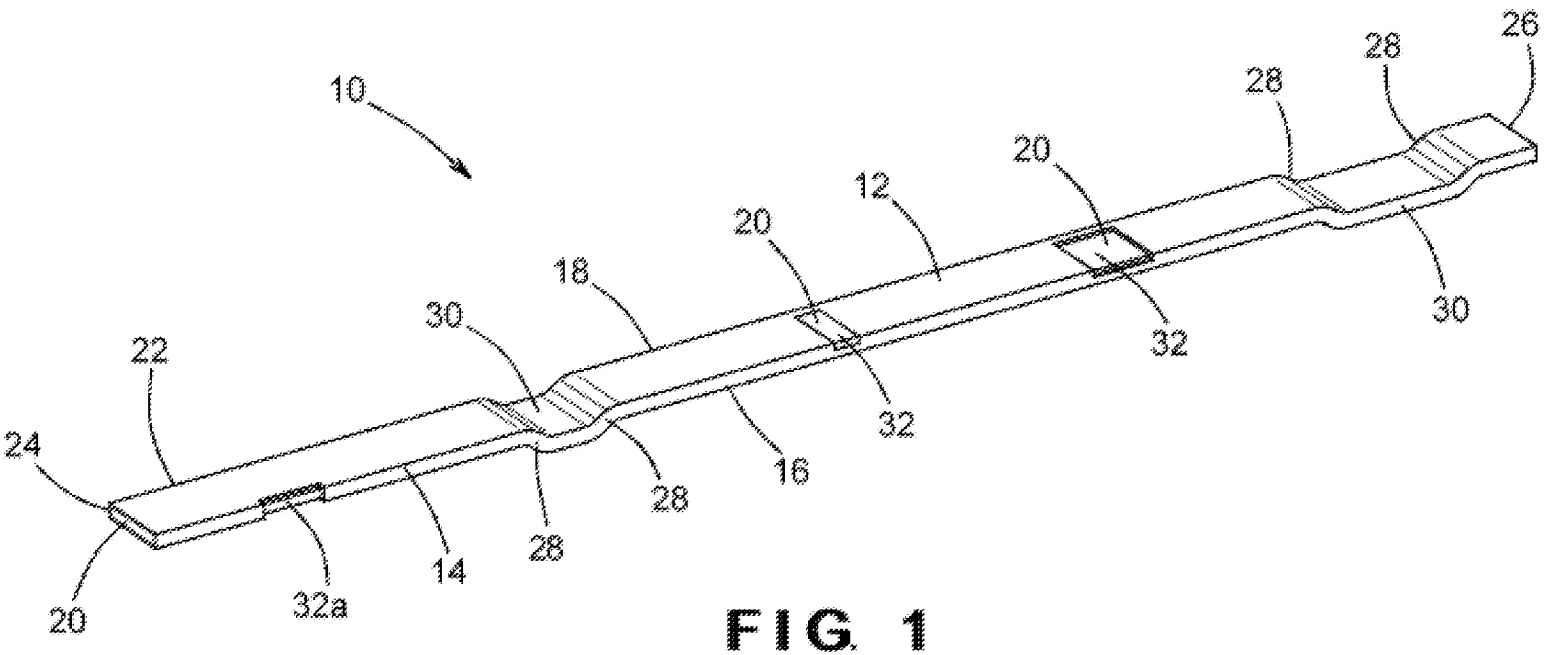
FIG. 1 is a perspective view of a bus bar.

Referring now to the drawings, there is illustrated in FIG. 1 a perspective view of a bus bar, indicated generally at 10. The illustrated bus bar 10 has a rectangular cross-sectional shape, with four sides including a first face 12, a second face 14, a third face 16 that is opposed the first face 12, and a fourth face 18 that is opposed the second face 14 However the bus bar 10 may have any desired shape. The illustrated bus bar 10 is a solid, rigid bus bar, but may be a flexible bus bar if desired. The illustrated bus bar 10 is an insulated bus bar, and includes a conductive portion 20 surrounded by an electrical insulation 22. The illustrated conductive portion 20 is made of aluminum, but may be made of any desired material and the illustrated insulation 22 is an epoxy coating, but may be made of any desired material. The insulation 22 is located on the four faces 12, 14, 16, and 18 of the bus bar 10. The bus bar 10 extends from a first end 24 to a second end 26, and conductive portion 20 is not covered by the insulation 22 on the first end 24 and second end 26. However, the bus bar 10 may have the insulation 22 located on any desired locations including none of the bus bar 10 (an uninsulated bus bar 10) or the entire surface of the bus bar 10 may be insulated. The illustrate bus bar 10 may be connected to any desired electrical components or electrical conductors (not shown) at the first end 24 and the second end 26.

The illustrated bus bar 10 extends linearly between the first end 24 and the second end 26, but includes bends 28 which create protrusions 30 that are offset from the line between the first end 24 and the second end 26. The purpose of the protrusions 30 will be described below. The bus bar 10 may have any desired shape between the first end 24 and the second end 26, and may include straight or curved portions if desired. The bus bar 10 also includes insulation cut-outs 32 and 32*a* where the insulation 22 is removed to expose the conductive portion 20. In the illustrated embodiment, part of the insulation 22 is removed by stripping. However, the insulation 22 may be removed by any desired mechanism or method, or the cut-outs 32 and 32*a* may be created by not placing any insulation 22 in desired locations during the installation of the insulation 22 on the bus bar 10. The illustrated bus bar 10 includes three cut outs 32 and 32*a*, but may include any desired number of cut outs 32 and 32*a*. The illustrated cut outs 32 extend predominately along the relatively large first face 12 and a small distance along the relatively small second face 14, while the cut out 32*a* is located predominately on the second face 14. However, the cut outs 32 and 32*a* may be located on any desired face 12, 14, 16, and 18 of the bus bar 10, and may extend onto multiple faces 12, 14, 16, and 18 of the bus bar 10, if desired.

Figure 2:
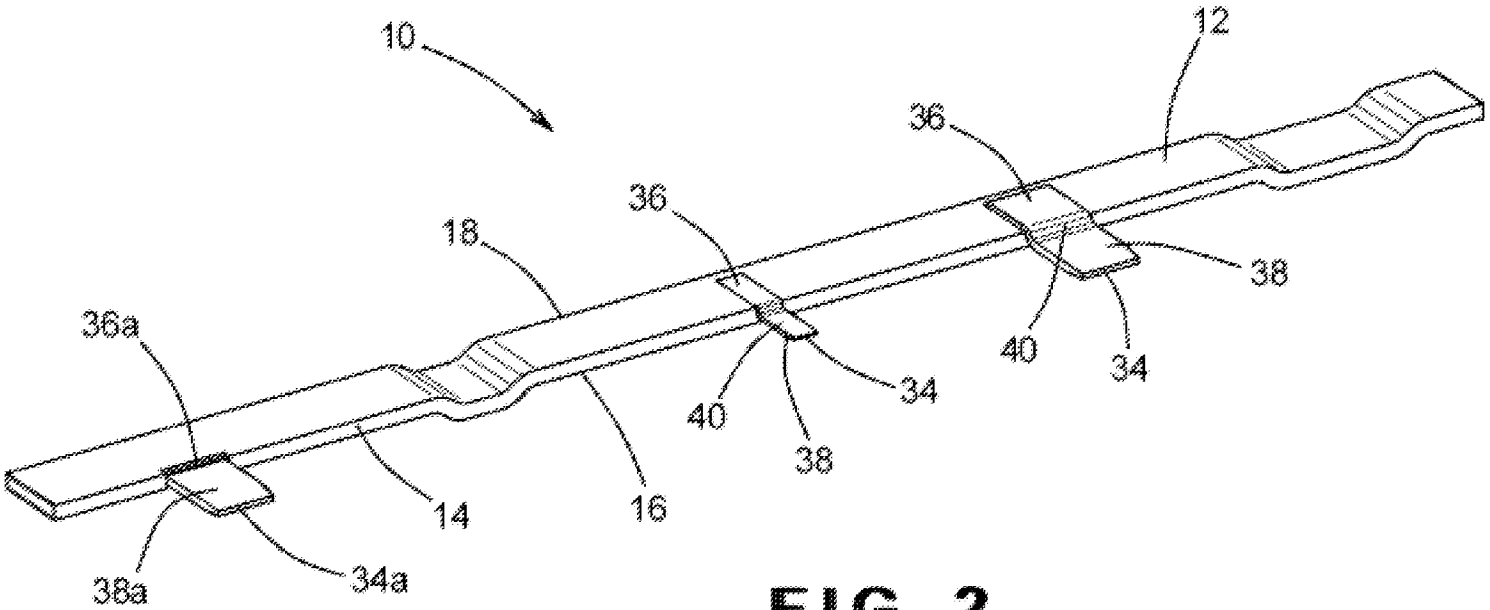
FIG. 2 is a perspective view similar to FIG. 1, showing a plurality of electrical terminals connected to the bus bar.

Referring to FIG. 2, the bus bar 10 is shown with a plurality of terminals 34 and 34*a* attached thereto. The illustrated terminals 34 are attached to the conductive portion 20 of the bus bar 10 with one terminal 34 located at each cut out 32. Each terminal 34 includes a connection portion 36 that is connected to the first face 12 of the bus bar 10 by welding. However, the terminal 34 may be attached to the bus bar 10 by any desired method and may be formed as part of the bus bar 10, if desired. Each terminal 34 includes a contact portion 38 which serves to connect with a corresponding connector, as will be described below. The illustrated contact portions 38 extend from the second face 14 of the bus bar 10 and are substantially parallel to the first face 12. However, the contact portions 38 may extend from the bus bar 10 in any desired direction. The illustrated contact portions 38 are male blade terminals, but may be any desired type of terminal. Each terminal 34 includes an optional offset 40 located between the connection portion 36 and the contact portion 38. The offset 40 is a bend in the terminal 34 that positions the contact portion 38 so that it extends away from the bus bar 10 substantially from the center of the second face 14. However, the contact portion 38 may be located in any desired position relative to the second face 14 or any other face 12, 16, and 18 of the bus bar 10.

The illustrated terminal 34*a* is attached to the conductive portion 20 of the bus bar 10 and is located in the cut out 32*a*. The terminal 34*a* includes a connection portion 36*a* that is connected to the second face 14 of the bus bar 10 by welding. However, the terminal 34*a* may be attached to the bus bar 10 by any desired method and may be formed as part of the bus bar 10, if desired. The terminal 34*a* includes a contact portion 38*a* which serves to connect with a corresponding terminal, as will be described below. The illustrated terminal 34*a* abuts the second face 14 of the bus bar 10 and the contact portion 38*a* extends from the second face 14 of the bus bar 10 substantially parallel to the first face 12. However, the contact portion 38*a* may extend from the bus bar 10 in any desired direction. The illustrated contact portion 38*a* is a male blade terminal, but may be any desired type of terminal.

In the illustrated embodiment, the contact portions 38 and 38*a* all extend from the second face 14 of the bus bar 10 and extend substantially parallel to the first face 12. However, the contact portions 38 and 38*a* may extend from any location on the bus bar 10 and may extend in any desired direction. The contact portions 38 and 38*a* may extend in different directions from each other, if desired. Additionally, the illustrated contact portions 38 and 38*a* all extend from the centerline of the second face 14 and are all substantially coplanar. However, the contact portions 38 and 38*a* may be located in different planes or have different relative orientations, if desired.

Figure 3:
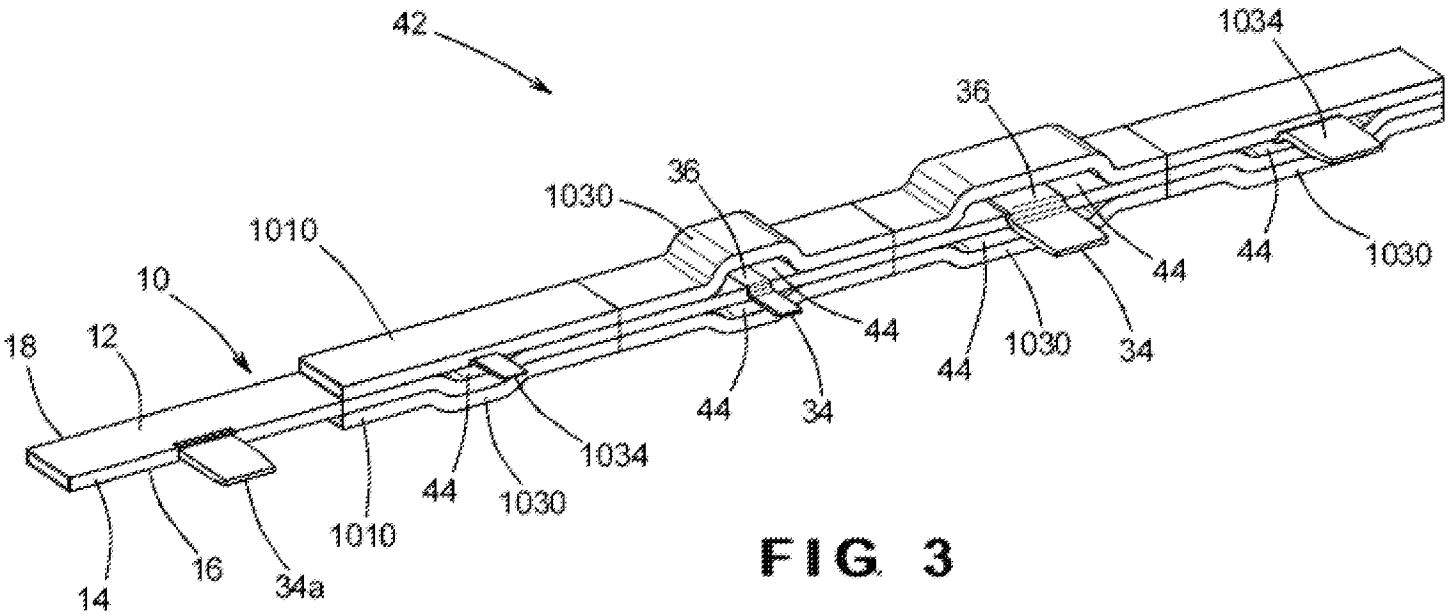
FIG. 3 is a perspective view of a bus bar assembly that includes the bus bar shown in FIG. 2.

Referring to FIG. 3, a perspective view of a bus bar assembly, indicated generally at 42, is shown. The bus bar assembly 42 includes the bus bar 10 attached to additional bus bars 1010. The illustrated bus bar assembly 42 includes a total of three bus bars 10 and 1010, but may include any desired number of bus bars 10 and 1010. The bus bar 10 is connected face-to-face to each of the adjacent bus bars 1010. The first face 12 of the bus bar 10 is in contact with one of the bus bars 1010, and the third face 16 of the bus bar 10 is in contact with another of the bus bars 1010. The illustrated bus bars 1010 are attached to the bus bar 10 by adhesives, but may be attached using any desired connector. The illustrated bus bars 1010 are insulated bus bars, but may be uninsulated if desired. The bus bars 10 and 1010 may be used to carry electrical signals or power independent of each other, if desired. The bus bars 1010 may have terminals 1034 attached if desired, and these terminals will not be described in detail.

As previously described, the bus bar 10 includes protrusions 30 that are offset from the line between the first end 24 and the second end 26. As seen in FIG. 3, the protrusions 30 create assembly gaps 44 between the bus bar 10 and the adjacent bus bar 1010. Additionally, the bus bars 1010 include protrusions 1030 that create additional assembly gaps 44. It should be appreciated that the assembly gaps 44 are localized areas where adjacent bus bars 10 and 1010 are not in contact with each other, and the assembly gaps 44 may be created by one or more of the bus bars 10 and 1010 including bends, curves, cuts, or other desired shapes. As shown, the connection portions 36 of the terminals 34 are located in the assembly gaps 44. Additionally, one of the assembly gaps 44 is located on the side of the bus bar 10 opposite the connection portion 36. Also, an assembly gap 44 is located adjacent the connection portion 36*a* of the terminal 34*a*. However, the assembly gaps 44 may be located in any desired locations on the bus bar assembly 42. The purpose of the assembly gaps 44 will be described below.

Figure 4:
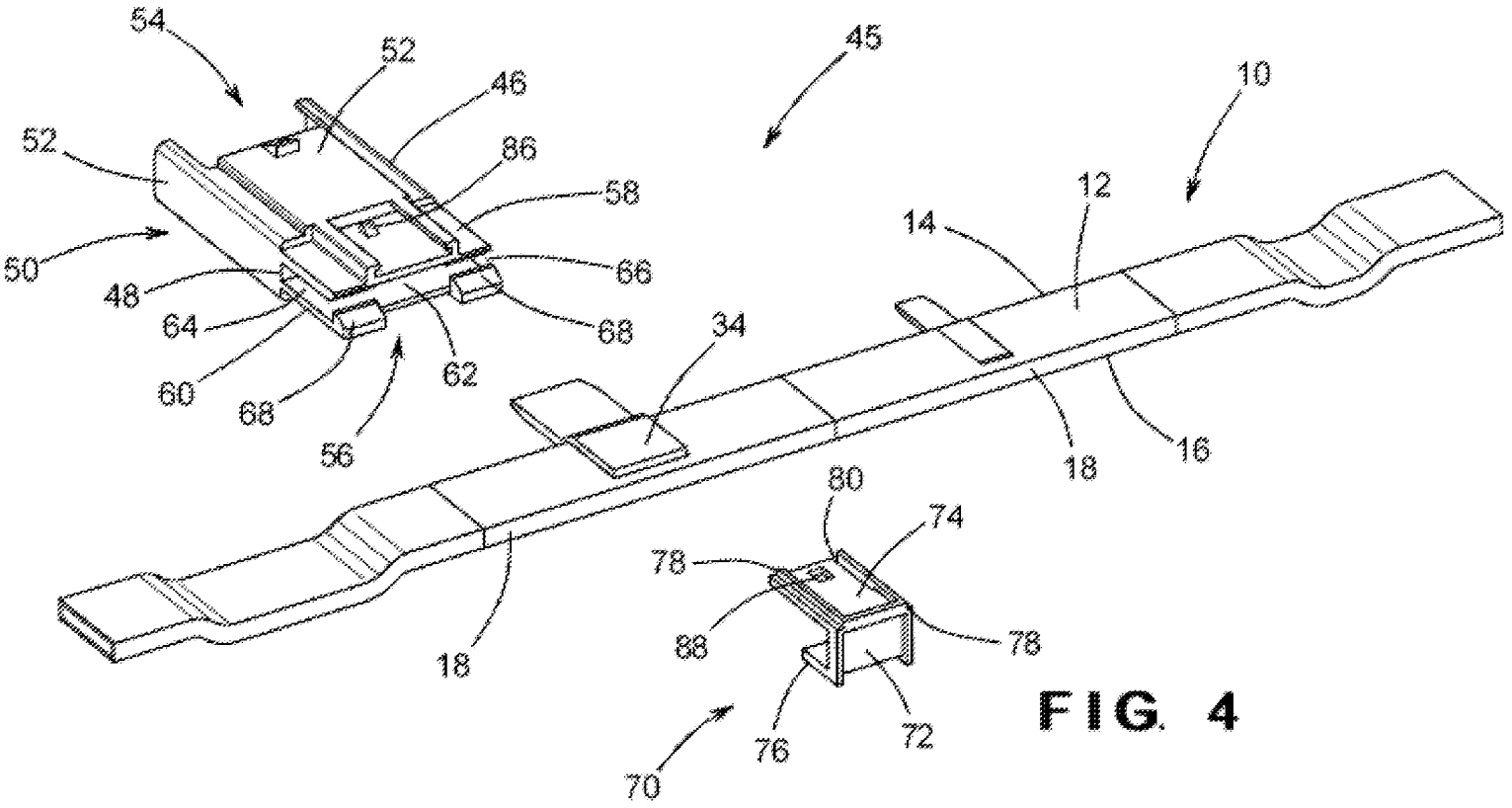
FIG. 4 is an enlarged perspective view, from behind, of a portion of the bus bar from FIG. 2 and an unassembled header assembly.

Referring to FIG. 4, a header assembly, indicated generally at 45, is shown prior to connection to the bus bar 10. The header assembly 45 includes a header 46. The illustrated header 46 is made of plastic, but may be made of any desired material. The header 46 includes a header base 48. A header shroud, indicated generally at 50, extends from the header base 48. The header shroud 50 includes a plurality of shroud walls 52 that define a terminal space 54. The header shroud 50 is configured to engage and mate with a corresponding electrical connector (connector 90, shown in FIG. 7), as will be described below. The header 46 also includes an engagement portion, indicated generally at 56, that extends from the header base 48. The illustrated engagement portion 56 extends from the opposite side of the header base 48 from the header shroud 50, but may be located in any desired part of the header base 48. As will be described below, the engagement portion is configured to engage the bus bar 10.

The illustrated engagement portion 56 includes a first flange 58 that extends from the header base 48. The engagement portion 56 also includes a second flange 60 that also extends from the header base 48. In the illustrated embodiment, the second flange 60 is substantially parallel to the first flange 58. However, the first flange 58 and the second flange 60 may have any desired relative orientations. The engagement portion 56 includes a bus bar space 62 that is defined between the first flange 58 and the second flange 60. The engagement portion 56 includes a first bus bar opening 64 that is located between the first flange 58 and the second flange 60 and is adjacent to the bus bar space 62. The engagement portion 56 also includes a second bus bar opening 66 that is located between the first flange 58 and the second flange 60 and is adjacent to the bus bar space 62 on an opposite side of the bus bar space 62 from the first bus bar opening 64. The first bus bar opening 64 and the second bus bar opening 66 allow the engagement portion 56 to be positioned around the bus bar 10, as will be described below. The header 46 includes a header lock 68. The illustrated header lock 68 includes two protuberances located on the second flange 60 that extend toward the first flange 58. The header lock 68 serves to retain the header 46 in position on the bus bar 10, as will be described below.

The header assembly 45 also includes a header position assurance 70 that serves as a secondary lock to retain the header 46 on the bus bar 10 and to ensure that the header 46 is properly positioned on the bus bar 10, as will be described below. The illustrated header position assurance 70 is molded from plastic, but may be made of any desired material and by any desired process. The header position assurance 70 includes a header position assurance base 72. A first header position assurance arm 74 extends from the header position assurance base 72, and a second header position assurance arm 76 also extends from the header position assurance base 72. The illustrated first header position assurance arm 74 and second header position assurance arm 76 are parallel, but may have any desired relative orientation. The illustrated header position assurance 70 includes a plurality of optional ridges 78 that increase the structural rigidity of the header position assurance 70. The header position assurance 70 also includes a hinge 80 on the first header position assurance arm 74. The illustrated hinge 80 is a thin portion area that allows the first header position assurance arm 74 to deflect relative to the header position assurance base 72.

Figure 5:
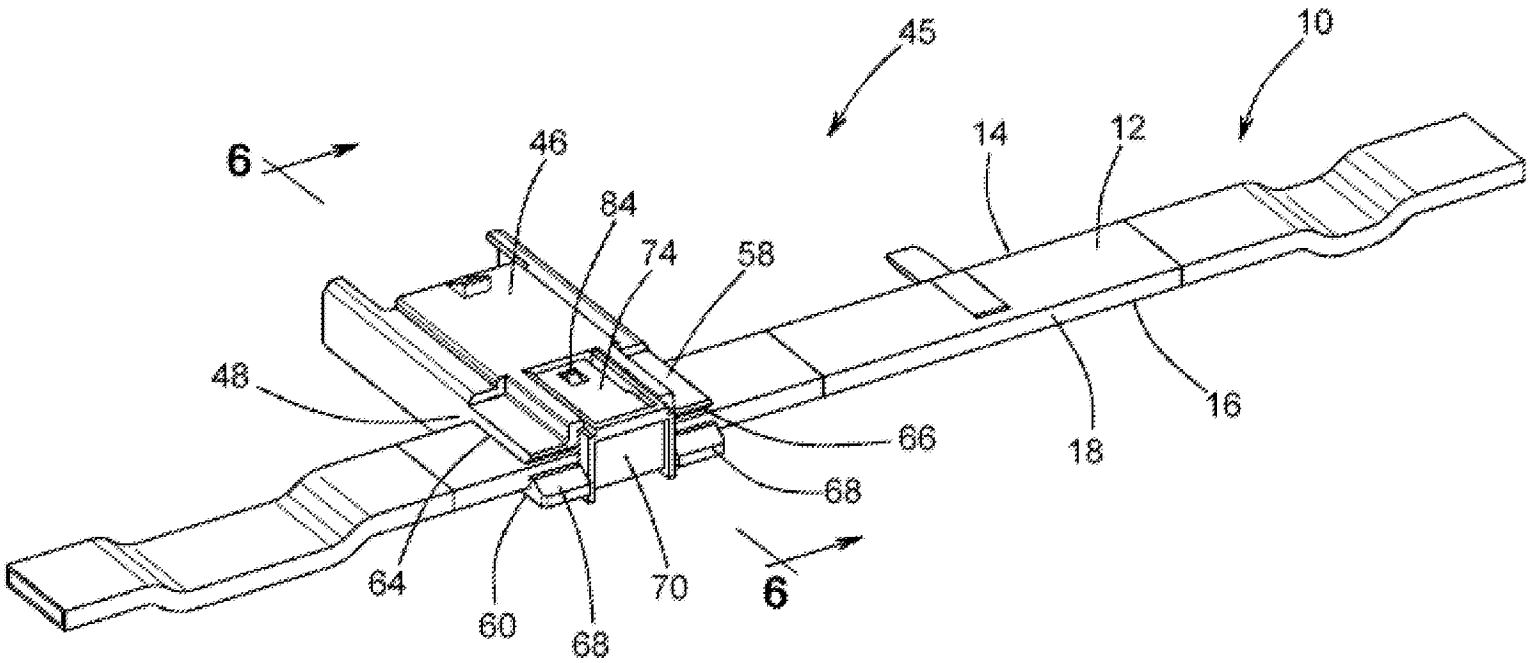
FIG. 5 is a view similar to FIG. 4, showing the header assembly in an assembled state.
Figure 6:
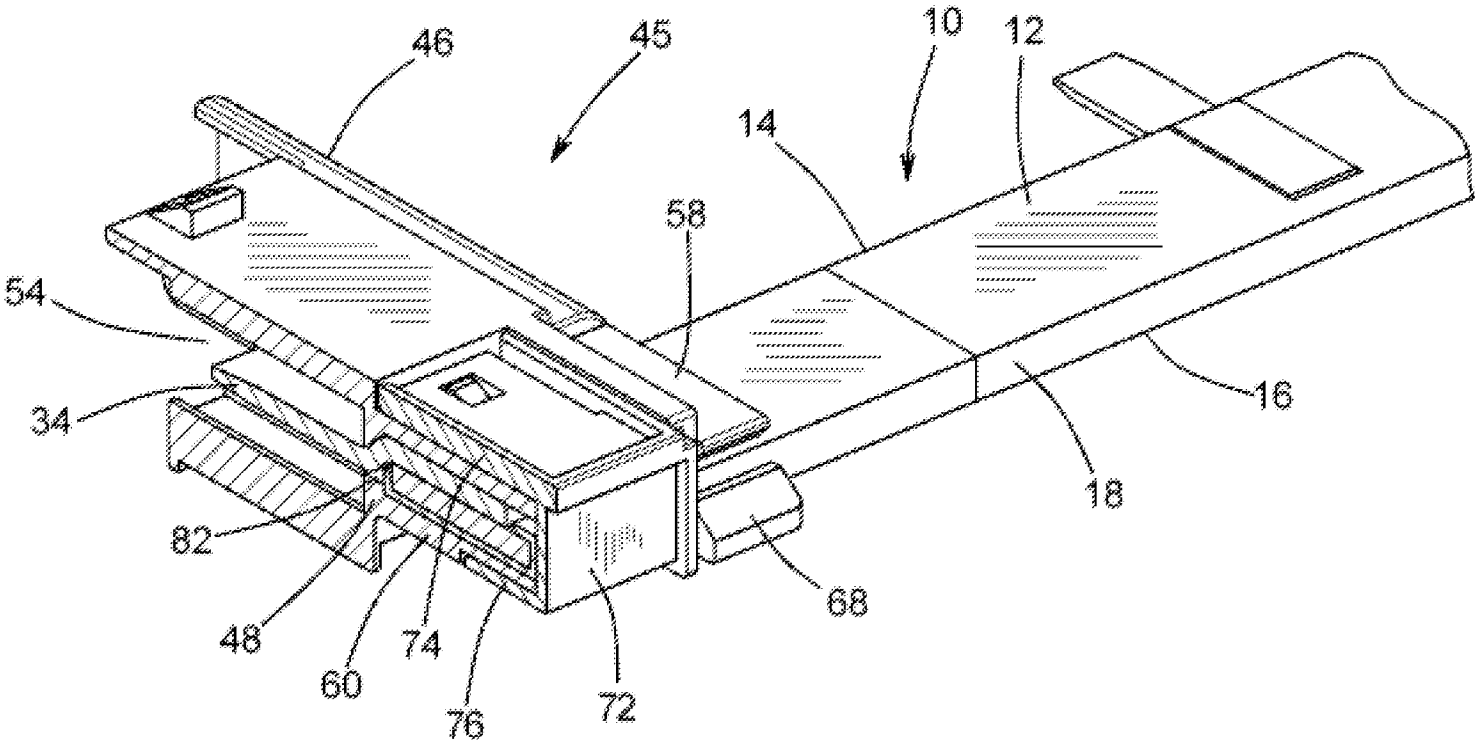
FIG. 6 is a cross-sectional view taken along the line 6-6 of FIG. 5.

Referring to FIG. 5, the header assembly 45 is shown assembled and FIG. 6 illustrates a cross-sectional view taken along the line 6-6 of FIG. 5. The header 46 is positioned so that the bus bar 10 passes through the first bus bar opening 64 and the second bus bar opening 66 and a portion of the bus bar 10 is located in the bus bar space 62. Additionally, the header position assurance 70 is located on the opposite side of the bus bar space 62 from the header base 48. The header 46 includes a terminal opening 82 passing through the header base 48 between the bus bar space 62 and the terminal space 54. The illustrated terminal opening 82 is defined through the header base 48, but may be in any desired location on the header 46. When the bus bar assembly 42 is assembled, the terminal 34 extends through the terminal opening 82, and is located partially in the terminal space 54.

The first flange 58 of the header 46 is engaged with the first face 12 of the bus bar 10, the protuberances are engaged with the second face 14 of the bus bar 10, the second flange 60 is engaged with the third face 16 of the bus bar 10, and the header base 48 is engaged with the fourth face of the bus bar 10. This engagement retains the header 46 in position relative to the bus bar 10. Additionally, the terminal 34 located in the terminal opening 82 is engaged with the header base 48 and also retains the header 46 in position relative to the bus bar 10.

When the header assembly 45 is assembled, the header position assurance 70 is positioned on an opposite side of the bus bar space 62 from the header base 48 and extends between the first flange 58 and the second flange 60. The header position assurance base 72 is engaged with the second face 14 of the bus bar 10. The first header position assurance arm 74 is engaged with the first flange 58 of the header 46, and the second header position assurance arm 76 is engaged with the second flange 60. The header assembly 45 includes a header position assurance lock 84 that retains the header position assurance 70 on the engagement portion 56 of the header 46. The illustrated header position assurance lock 84 includes a latch 86 on the header 46 and a catch 88 on the header position assurance 70. The hinge 80 on the header position assurance 70 allows the first header position assurance arm 74 to resiliently deflect relative to the first flange 58 so that the latch 86 can be engaged by the catch 88. However, the header position assurance lock 84 may be any desired retainer or retaining mechanism.

Figure 7:
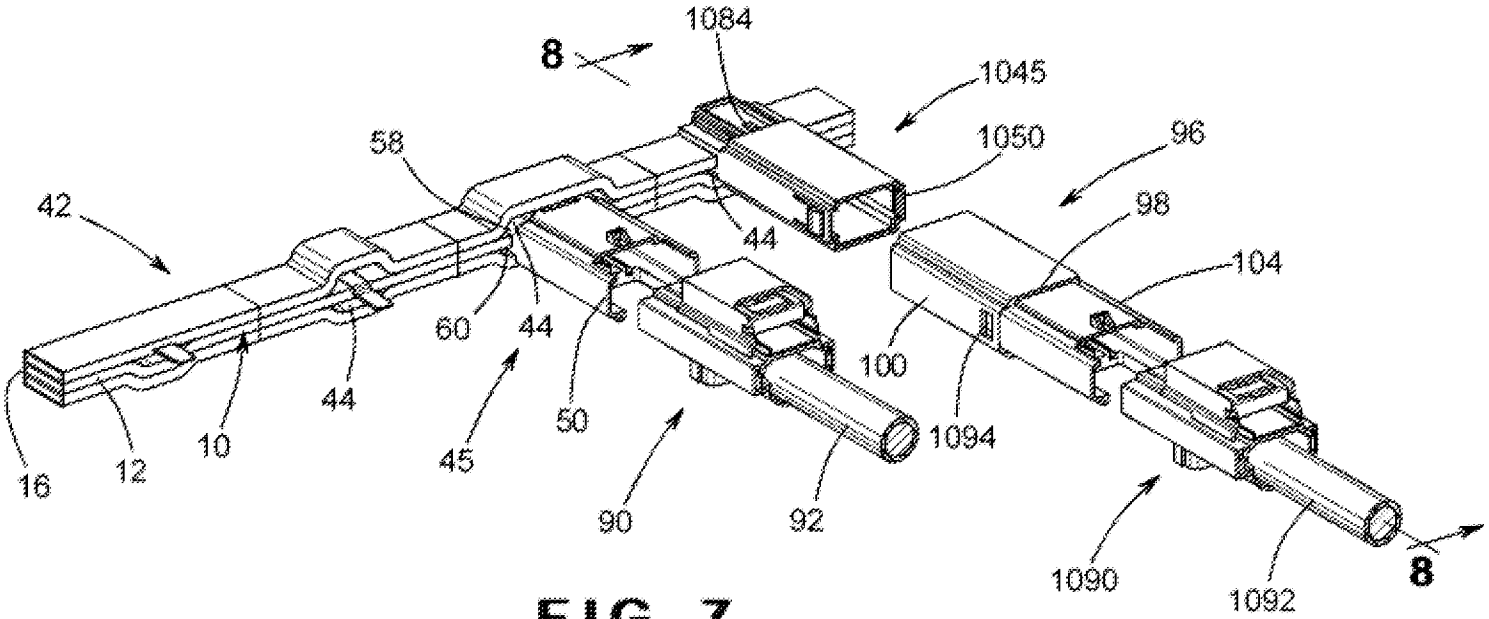
FIG. 7 is a perspective view of the bus bar assembly from FIG. 3, shown with two header assembles attached thereto.

Referring to FIG. 7, a perspective view of the bus bar assembly 42 is illustrated with the header assembly 45 attached thereto. In the illustrated embodiment, the first flange 58 is located in one of the assembly gaps 44 of the bus bar assembly 42 and the second flange 60 is located in another of the assembly gaps 44. The assembly gaps 44 are provided to allow space for the first flange 58 and the second flange 60 to be located adjacent to the first face 12 and the third face 16 of the bus bar 10. However, the engagement portion 56 of the header 46 may be configured to fit around the entire bus bar assembly 42 rather than just the bus bar 10, if desired. The header assembly 45 is configured to mate with a corresponding connector 90. The corresponding connector 90 is attached to an electrical conductor 92 which is attached to a corresponding terminal (not shown) housed in the connector 90. However, the header assembly 45 may be configured to attach to any desired electrical connector. The illustrated header shroud 50 includes a connector catch 94 that is configured to lock the connector 90 in position relative to the header 46.

Figure 8:
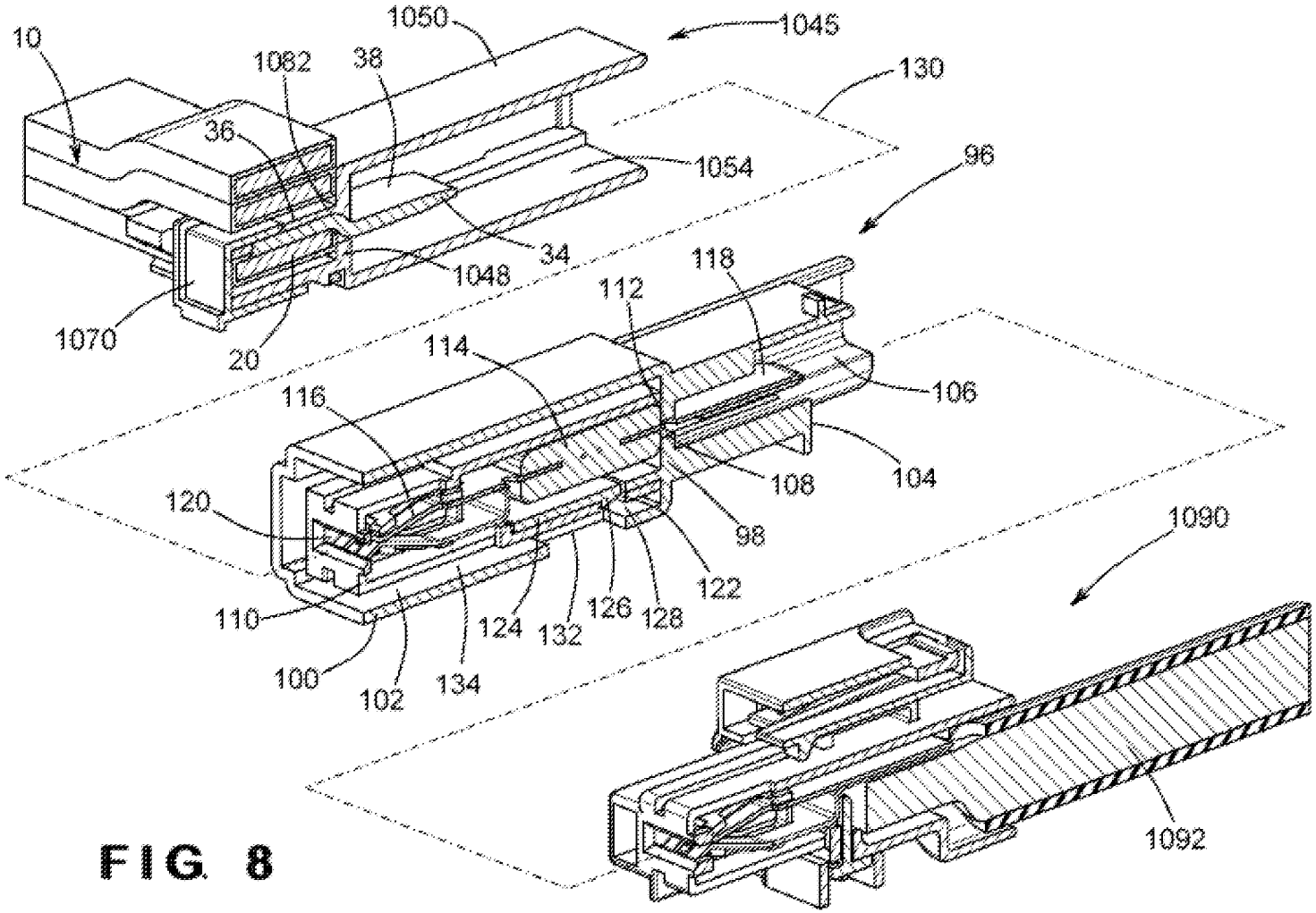
FIG. 8 is a cross-sectional view taken along the line 8-8 of FIG. 7 through an adapter and a second header assembly.

FIG. 7 also shows a second header assembly 1045 attached to the bus bar assembly 42. The second header assembly 1045 is substantially similar to the previously-described header assembly 45 and similar elements are identified by the same element number increased by 1000. The illustrated second header assembly 1045 includes a header shroud 1050 with a different configuration than the header shroud 50, and is configured to mate with an adapter 96 as will be described below. A cross-sectional view of the adapter 96, taken along the line 8-8 of FIG. 7, is shown in FIG. 8.

The illustrated adapter 96 is made of plastic, but may be made of any desired material. The adapter 96 includes an adapter base 98. A fuse shroud 100 extends from the base 98 and defines a fuse cavity 102. An adapter shroud 104 also extends from the adapter base 98 and defines an adapter terminal space 106. In the illustrated embodiment, the fuse cavity 102 and the adapter terminal space 106 are on opposite sides of the adapter base 98, but they may have any desired relative positions. The adapter 96 includes a fuse terminal opening 108 passing through the adapter base 98 between the fuse cavity 102 and the adapter terminal space 106. The illustrated fuse terminal opening 108 is defined in the adapter base 98, but may be in any desired location on the adapter 96.

The adapter 96 includes a fuse enclosure 110. The illustrated fuse enclosure 110 is a separate piece, but may be part of the fuse shroud 100 if desired. The illustrated fuse enclosure 110 is made of plastic, but may be made of any desired material. The fuse enclosure 110 includes an open end 112 that is configured for the insertion of a fuse 114 into the fuse enclosure 110. The fuse 114 includes an attached first fuse terminal 116 and an attached second fuse terminal 118 at opposite sides of the fuse 114. The illustrated first fuse terminal 116 is a spring-reinforced female terminal, but may be any desired type of terminal. The fuse 114 is inserted into the fuse enclosure 110 so that the first fuse terminal 116 is located within the fuse enclosure 110 and is aligned with a terminal opening 120 defined in the fuse enclosure 110. The illustrated second fuse terminal 118 is a male blade terminal, but may be any desired type of terminal. When the fuse 114 is inserted into the fuse enclosure 110, the second fuse terminal 118 extends out of the fuse enclosure 110 through the open end 112.

The fuse enclosure 110 is positioned in the fuse cavity 102 so that the second fuse terminal 118 extends through the fuse terminal opening 108 in the adapter base 98. The second fuse terminal 118 is located at least partially within the adapter terminal space 106. The adapter 96 includes a fuse lock, indicated generally at 122, that retains the fuse 114 in the adapter 96. The illustrated fuse lock 122 includes a resilient lock arm 124 within the fuse enclosure 110 that includes a latch 126 that engages a catch 128 on the fuse enclosure 110. The latch 126 engages the fuse enclosure 110 to prevent the fuse enclosure 110 from being removed from the fuse cavity 102. However, the fuse lock 122 may be any desired retainer or mechanism. When the fuse enclosure 110 is installed in the fuse cavity 102, the fuse 114 is retained by the fuse enclosure 110 at one end and the adapter base 98 at the other end.

The assembled adapter 96 provides a female-male linear fuse assembly. The fuse 114 is provided with the female terminal 116 at one end and the male terminal 118 at the other end, each of which are configured to mate with respective corresponding terminals inserted along a fuse axis 130. The illustrated fuse shroud 100 includes an optional lock window 132 that allows an operator to release the fuse lock 122. In the illustrated embodiment, a finger or tool may be inserted through the lock window 132 to deflect the latch 126 out of engagement with the fuse enclosure 110. This allows the operator to remove the fuse enclosure 110 from the adapter 96 in order to replace or service the fuse 114. The adapter 96 may not have the illustrated lock window 132, or the fuse lock 122 may be a relatively permanent connection such as an adhesive, in order to provide an adapter 96 with a fuse 114 that is not serviceable. In that case, the adapter 96 may be replaced when it is desired to replace the fuse 114.

Figure 9:
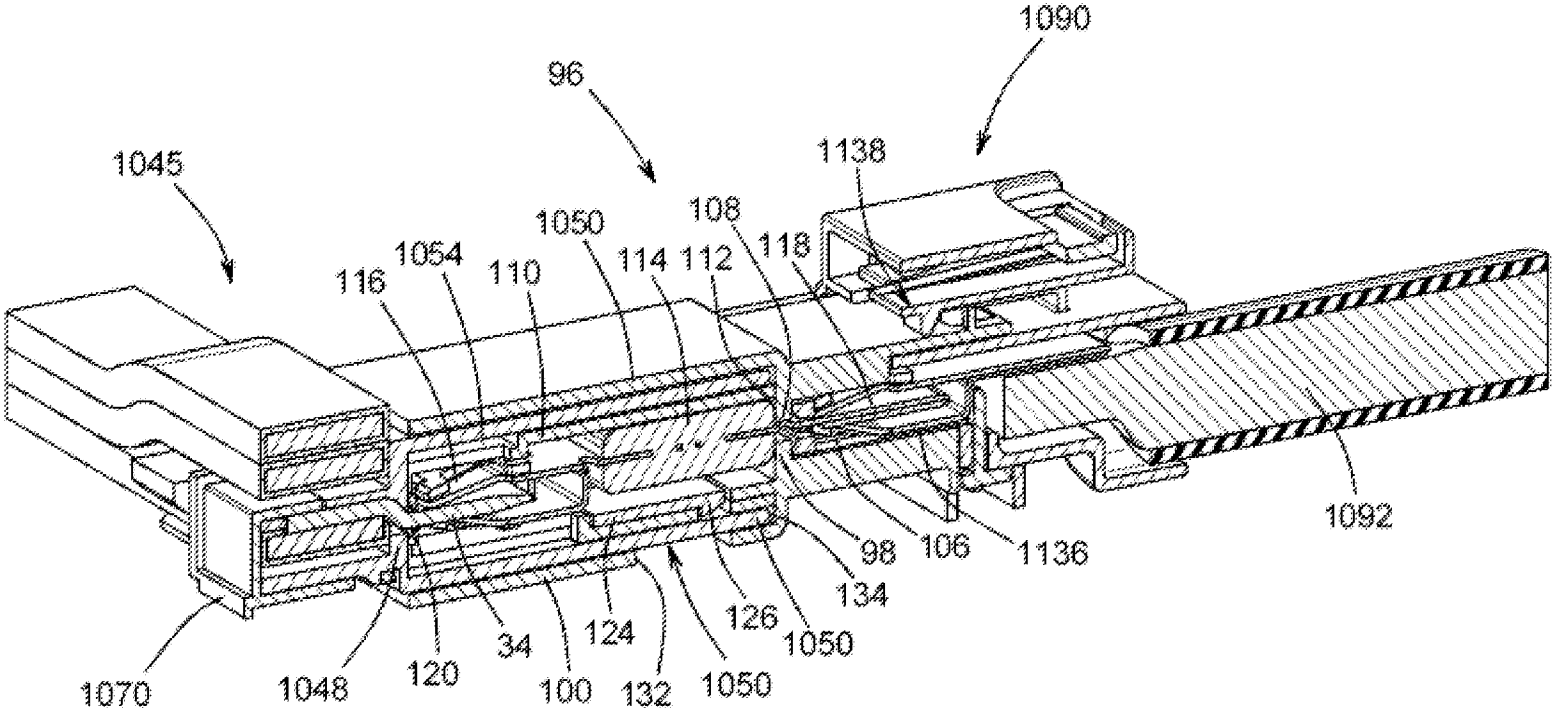
FIG. 9 is a cross-sectional view similar to FIG. 8, showing the adapter connected to the second header assembly.

FIG. 9 is a cross-sectional view similar to FIG. 8, showing the adapter 96 mated with the second header assembly 1045 and with a connector 1090. When the adapter 96 is mated with the second header assembly 1045, the adapter 96 is moved relative to the second header assembly 1045 so that the terminal 34 moves along the fuse axis 130 through the terminal opening 120 and engages the first fuse terminal 116 inside the fuse enclosure 110. The fuse enclosure 110 is located within a terminal space 1054 defined by the header shroud 1050. The adapter 96 includes a shroud space 134 that is located in the fuse cavity 102 between the fuse shroud 100 and the fuse enclosure 110. When the adapter 96 is mated with the second header assembly 1045, the header shroud 1050 is located at least partially within the shroud space 134. In the illustrated embodiment, when the adapter 96 is mated with the second header assembly 1045 the header shroud 1050 is located between the lock window 132 and the fuse lock 122. As a result, the operator is unable to release the fuse lock 122. Thus, the fuse lock 122 cannot be released when the adapter is engaged with the second header assembly 1045.

The connector 1090 includes a connector terminal 1136 that is located in the adapter terminal space 106 and is engaged with the second fuse terminal 118 when the connector 1090 is mated with the adapter 96. A connector lock 1138 serves to retain the connector 1090 in position on the adapter 96.

Figure 10:
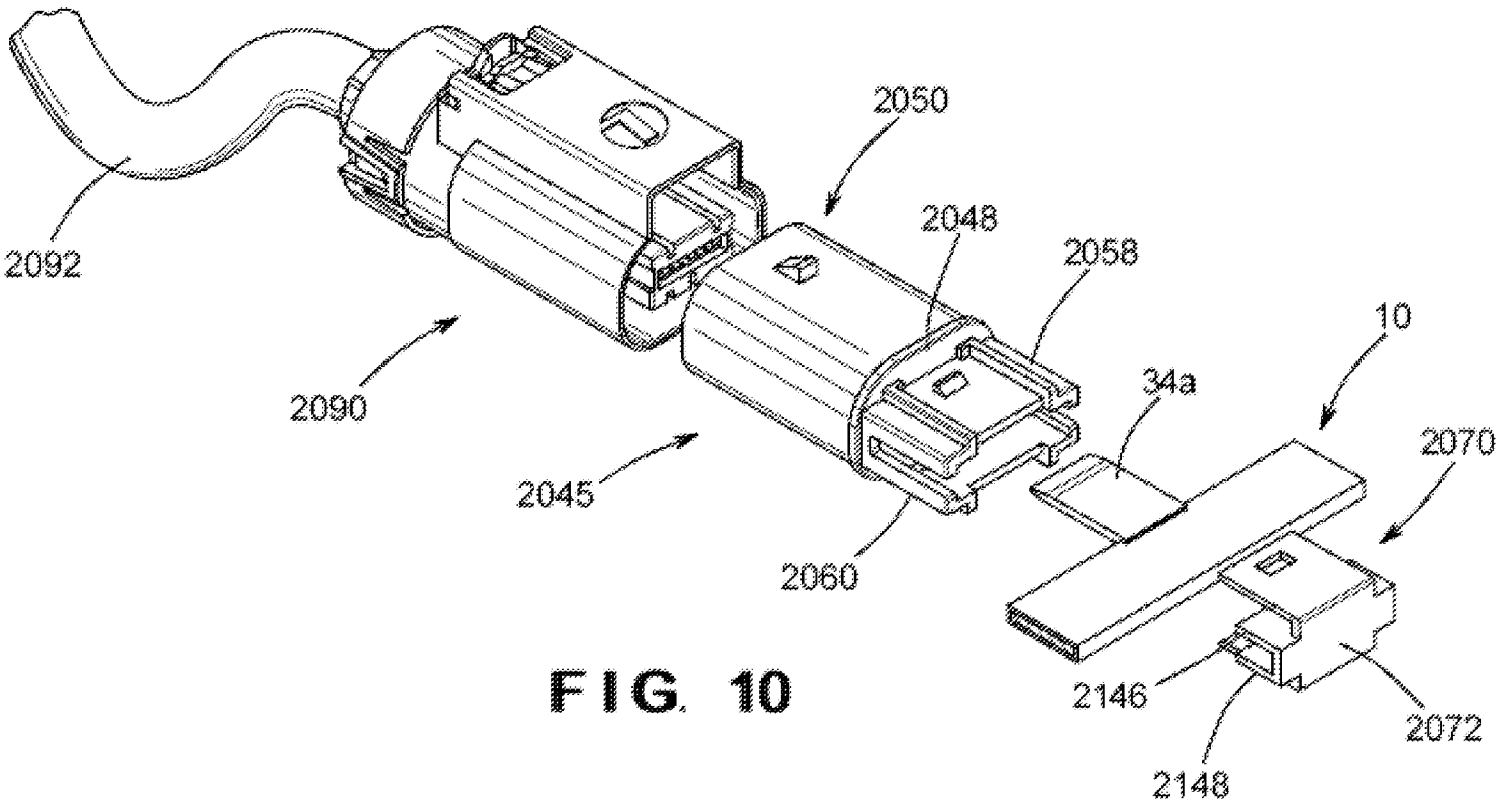
FIG. 10 is an enlarged, perspective view of a portion of the bus bar from FIG. 2 shown with a sealed header assembly in an unassembled state.
Figure 11:
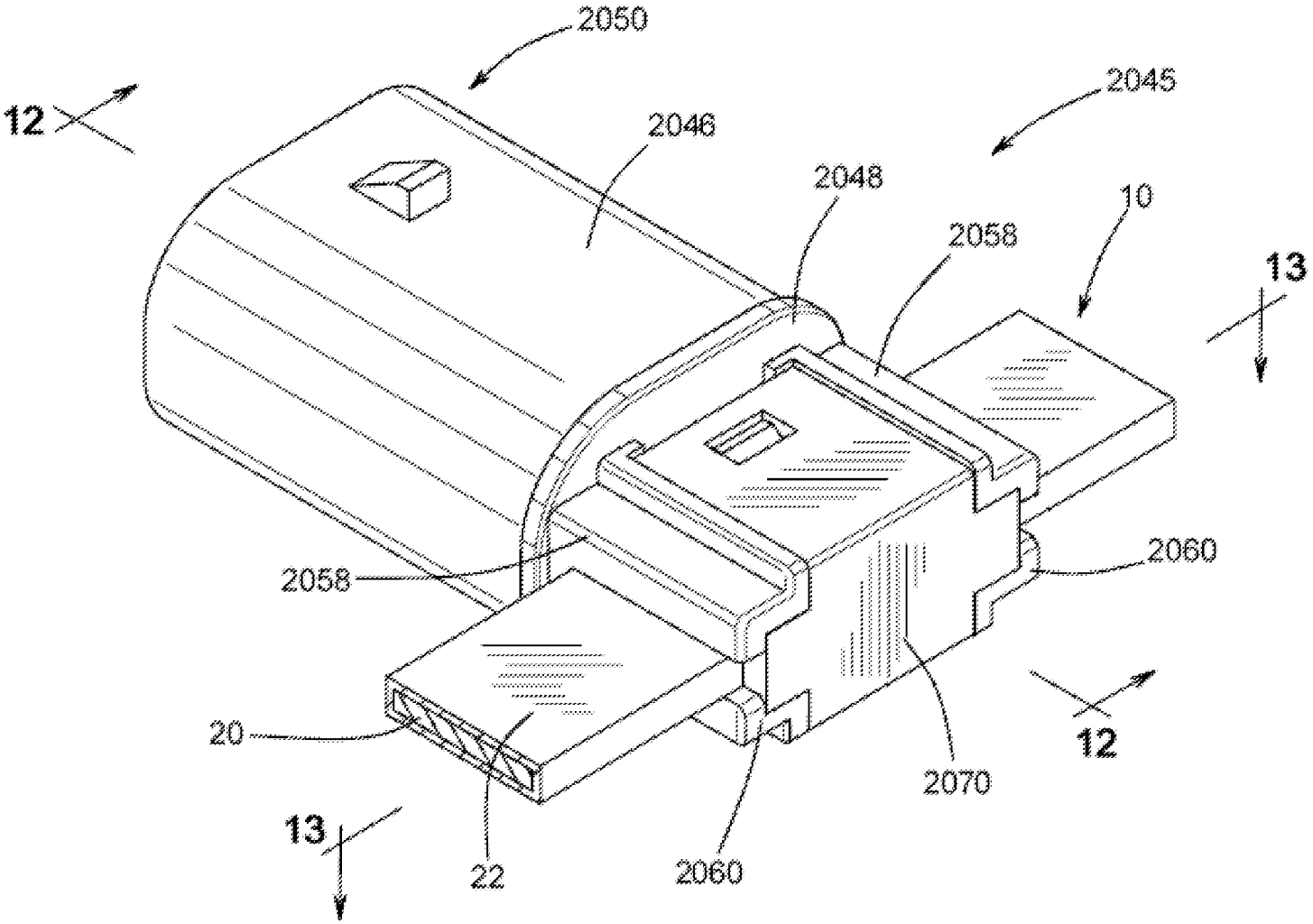
FIG. 11 is a perspective view similar to FIG. 10, showing the sealed header assembly in an assembled state.
Figure 12:
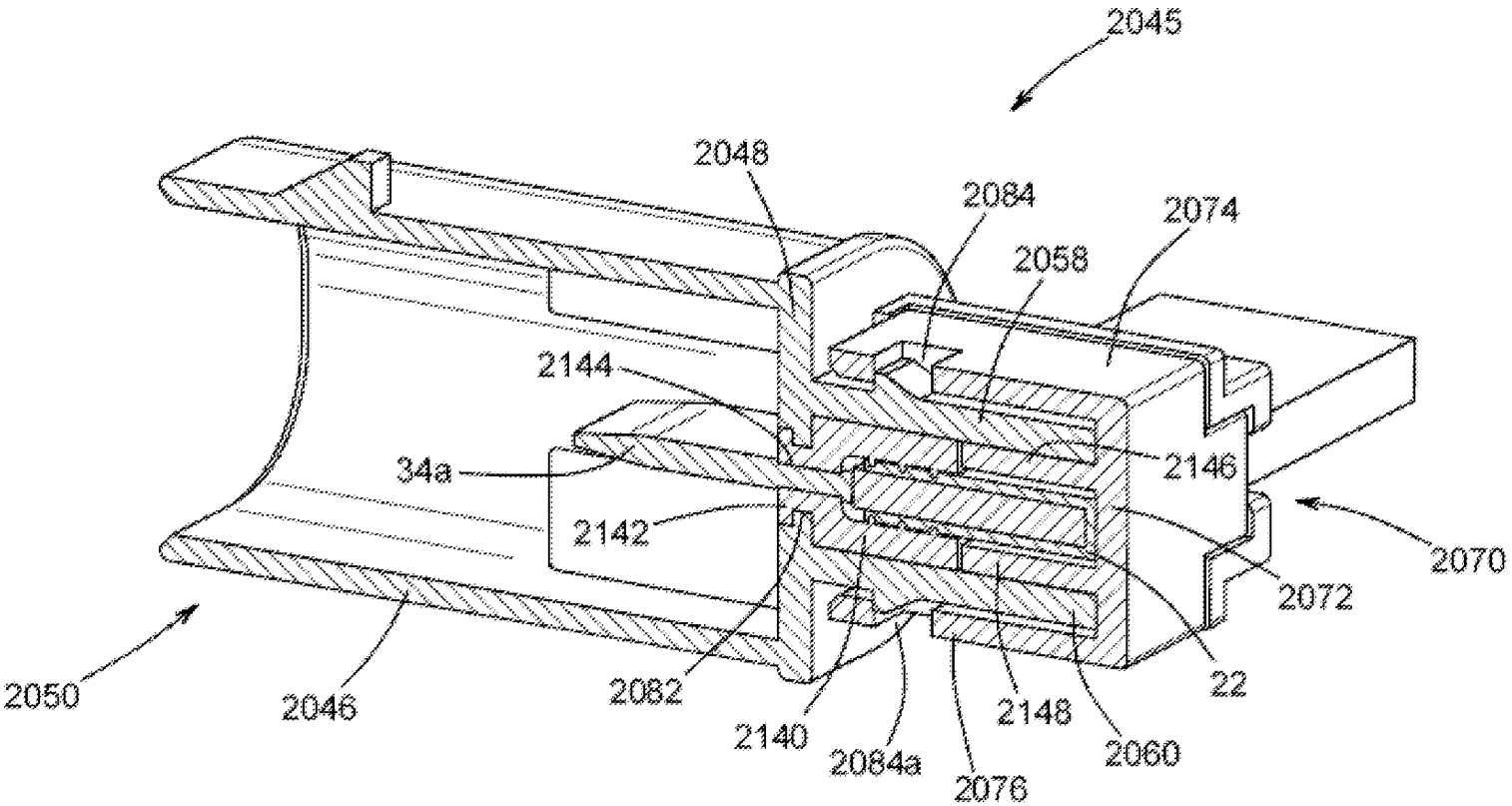
FIG. 12 is a cross-sectional view of the sealed header assembly taken along the line 12-12 of FIG. 11.

Referring to FIG. 10, a perspective view of a portion of the bus bar 10 including the terminal 34*a* is shown, along with a sealed header assembly, indicated generally at 2045. The sealed header assembly 2045 is substantially similar to the previously-described header assembly 45 and similar elements are identified by the same element number increased by 2000 and will not be described in detail. FIG. 11 is a perspective view similar to FIG. 10, showing the sealed header assembly 2045 in an assembled state on the bus bar 10. The sealed header assembly 2045 is configured to be connected to a sealed connector 2090 in order to protect the terminal 34*a* from water and other environmental contaminants while in use. Cross sectional views taken along lines 12-12 and 13-13 of FIG. 11 are shown in FIGS. 12 and 13, respectively.

The sealed header assembly 2045 includes a seal 2140 connected to a header 2046. The illustrated seal 2140 is made of an elastomeric material, but may be made of any desired material. The illustrated seal 2140 includes a pass-through portion 2142 that is positioned within a terminal opening 2082 defined in a header base 2048. The seal defines a terminal pass-through 2144 that allows the terminal 34*a* to pass through the seal 2140. The illustrated terminal pass-through 2144 is sized slightly smaller than the terminal 34*a* so that the seal 2140 engages the terminal 34*a*.

Figure 13:
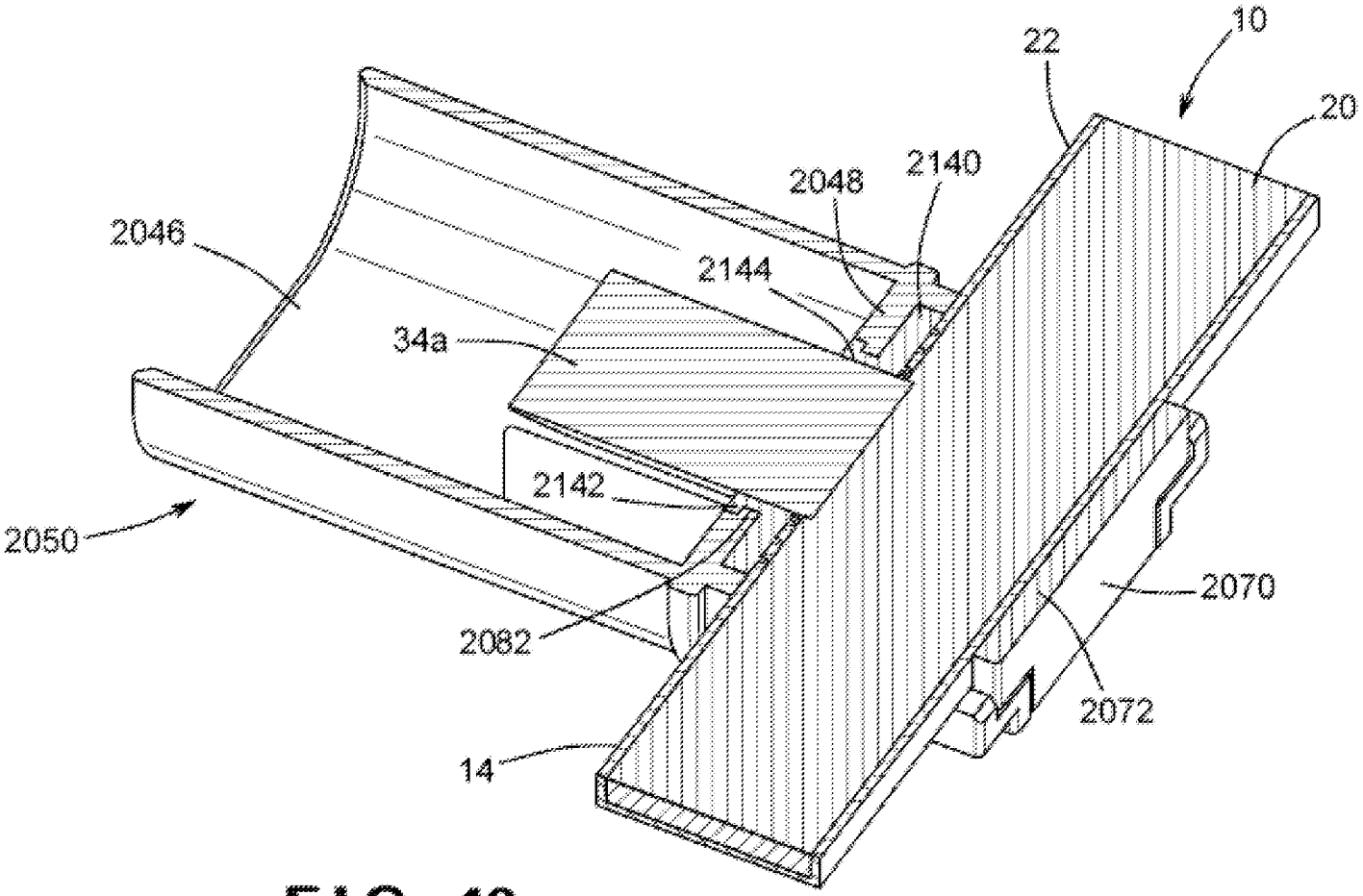
FIG. 13 is a cross-sectional view of the sealed header assembly taken along the line 13-13 of FIG. 11.

As seen in FIG. 13, the seal 2140 extends between the header base 2048 and the bus bar 10, and the seal 2140 engages the second face 14 of the bus bar 10. The illustrated seal 2140 engages the insulation 22 on the second face 14 of the bus bar 10. As seen in FIG. 12, the seal 2140 also extends between a first flange 2058 and the bus bar 10 and is engaged with the first face 12 of the bus bar 10. The seal 2140 engages the insulation 22 on the first face 12 of the bus bar 10. Additionally, the seal 2140 extends between a second flange 2060 and the bus bar 10 and is engaged with the third face 16 of the bus bar 10. The seal 2140 engages the insulation 22 on the third face 16 of the bus bar 10.

The sealed header assembly 2045 includes a header position assurance 2070 that is substantially similar to the previous described header position assurance 70. The illustrated header position assurance 2070 includes a header position assurance lock 2084 on a first header position assurance arm 2074, and a second header position assurance lock 2084*a* on a second header position assurance arm 2076. The header position assurance 2070 also includes a first position assurance seal contact 2146 and a second position assurance seal contact 2148 that extend from a header position assurance base 2072. Both position assurance seal contacts 2146 and 2148 are substantially parallel to the first header position assurance arm 2074 and the second header position assurance arm 2076. The first position assurance seal contact 2146 is located between the first flange 2058 and the bus bar 10, and is engaged with the seal 2140. Similarly, the second position assurance seal contact 2148 is located between the second flange 2060 and the bus bar 10, and is also engaged with the seal 2140. The first position assurance seal contact 2146 and the second position assurance seal contact 2148 serve to compress the seal 2140 between the header 2046 and the header position assurance 2070 in order to provide a waterproof seal.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A fuse adapter comprising:

an adapter base having an interior wall;

a fuse shroud that is integrally formed with the interior wall and extends from the interior wall in a first direction and defines a fuse cavity;

an adapter shroud that is integrally formed with the interior wall and extends from the interior wall in a second direction that is opposite to the first direction and defines an adapter terminal space;

a fuse terminal opening that extends through the interior wall from the fuse cavity to the adapter terminal space; and a fuse located within the fuse cavity, the fuse having a first fuse terminal that extends from the fuse in the first direction through the fuse cavity and a second fuse terminal that extends from the fuse in the second direction through the fuse terminal opening into the adapter terminal space.

2. The fuse adapter of claim 1, further comprising a fuse enclosure located within the fuse cavity, wherein the fuse and the first fuse terminal are located in the fuse enclosure.

3. The fuse adapter of claim 2, wherein the second fuse terminal extends out of the fuse enclosure.

4. The fuse adapter of claim 3, wherein the fuse enclosure is retained in the fuse cavity by a fuse lock.

5. The fuse adapter of claim 4, wherein the fuse shroud defines a lock window that provides access to the fuse lock.

6. The fuse adapter of claim 5, wherein a shroud space is defined between the fuse enclosure and the fuse shroud.

7. The fuse adapter of claim 6, further comprising a header mated with the fuse shroud and including a header shroud that is located within the shroud space.

8. The fuse adapter of claim 7, wherein the header shroud obstructs access to the fuse lock through the lock window.

9. An assembly comprising:

a header including a header shroud defining a terminal space and a terminal located within the terminal space; and a fuse adapter including:

an adapter base having an interior wall;

a fuse shroud that is integrally formed with the interior wall and extends from the interior wall in a first direction and defines a fuse cavity;

an adapter shroud that is integrally formed with the interior wall and extends from the interior wall in a second direction that is opposite to the first direction and defines an adapter terminal space;

a fuse terminal opening that extends through the interior wall from the fuse cavity to the adapter terminal space;

a fuse located within the fuse cavity, the fuse having a first fuse terminal that extends from the fuse in the first direction through the fuse cavity and a second fuse terminal that extends from the fuse in the second direction through the fuse terminal opening into the adapter terminal space; and a fuse enclosure located within the fuse cavity, wherein the terminal is located at least partially within the fuse enclosure, the header shroud is located within the fuse shroud, and the fuse enclosure is located within the header shroud.

10. The assembly of claim 9, wherein the fuse enclosure is retained in the fuse cavity by a fuse lock.

11. The assembly of claim 10, wherein the fuse shroud defines a lock window that provides access to the fuse lock.

12. The assembly of claim 11, wherein a shroud space is defined between the fuse enclosure and the fuse shroud.

13. The assembly of claim 12, wherein the header shroud is located within the shroud space.

14. The assembly of claim 13, wherein the header shroud obstructs access to the fuse lock through the lock window.

15. A fuse adapter comprising:

an adapter base having an interior wall;

a fuse shroud that is integrally formed with the interior wall and extends from the interior wall in a first direction and defines a fuse cavity;

an adapter shroud that is integrally formed with the interior wall and extends from the interior wall in a second direction that is opposite to the first direction and defines an adapter terminal space;

a fuse terminal opening that extends through the interior wall from the fuse cavity to the adapter terminal space;

a fuse enclosure retained within the fuse cavity, wherein a shroud space is located in the fuse cavity between the fuse shroud and the fuse enclosure; and a fuse located within the fuse enclosure, the fuse having a first fuse terminal that extends from the fuse in the first direction through the fuse enclosure and a second fuse terminal that extends from the fuse in the second direction through the fuse terminal opening into the adapter terminal space.

16. The fuse adapter of claim 15, wherein the fuse enclosure further comprises a terminal opening.

17. The fuse adapter of claim 16, wherein the first fuse terminal is aligned with the fuse terminal opening.

* * * * *